US005129113A

United States Patent [19]

Sherman

[11] Patent Number: 5,129,113

[45] Date of Patent: Jul. 14, 1992

[54] SYSTEM OF FABRIC COVERING

[76] Inventor: Ronald K. Sherman, 941 Crystal Lake #305, Pompano Beach, Fla. 33064

[21] Appl. No.: 729,318

[22] Filed: Jul. 15, 1991

Related U.S. Application Data

[63] Continuation-in-part of Ser. No. 702,910, May 20, 1991.

[51] Int. Cl.[5] ..... A47C 17/04

[52] U.S. Cl. ..... 5/12.1; 5/13; 5/14; 5/28; 5/54; 5/59.1

[58] Field of Search ..... 5/12.1, 13, 14, 28, 5/54, 57.1, 59.1; 16/223, 247, 250, 251; 297/118, 335

[56] References Cited

U.S. PATENT DOCUMENTS

| | | | |
|---|---|---|---|
| 1,344,825 | 6/1920 | Schram | 5/57.1 X |
| 1,612,687 | 12/1926 | Young | 5/13 X |
| 2,329,503 | 9/1943 | Young | 5/59.1 X |
| 3,047,886 | 8/1962 | Thienfelder et al. | 5/13 |

*Primary Examiner*—Michael F. Trettel
*Attorney, Agent, or Firm*—Melvin K. Silverman

[57] ABSTRACT

A fabric covering system for use with a hinge element of a convertible sofa bed a system includes a sofa base and sofa cushions having rigid bottom rotatably connected by hinge means to the top of a vertical front panel of a sofa. The fabric of the cushions is positioned beneath a resilient longitudinal strip which is situated between the lower face of the hinge and the top of the vertical front panel. The fabric of the cushions extends past the axial of the hinge and between the top of the vertical front panel and the bottom of the resilient strip.

1 Claim, 2 Drawing Sheets

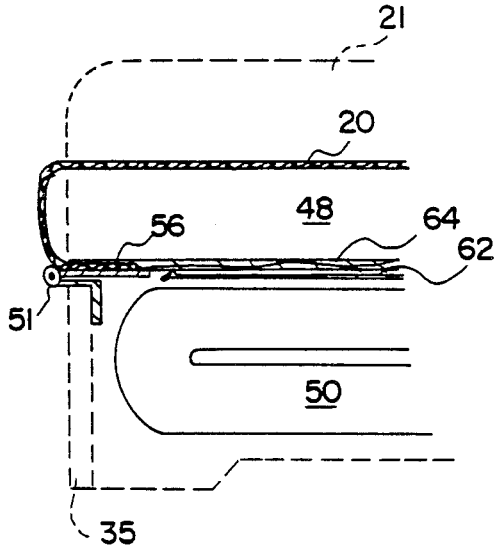
FIG. 1
FIG. 2
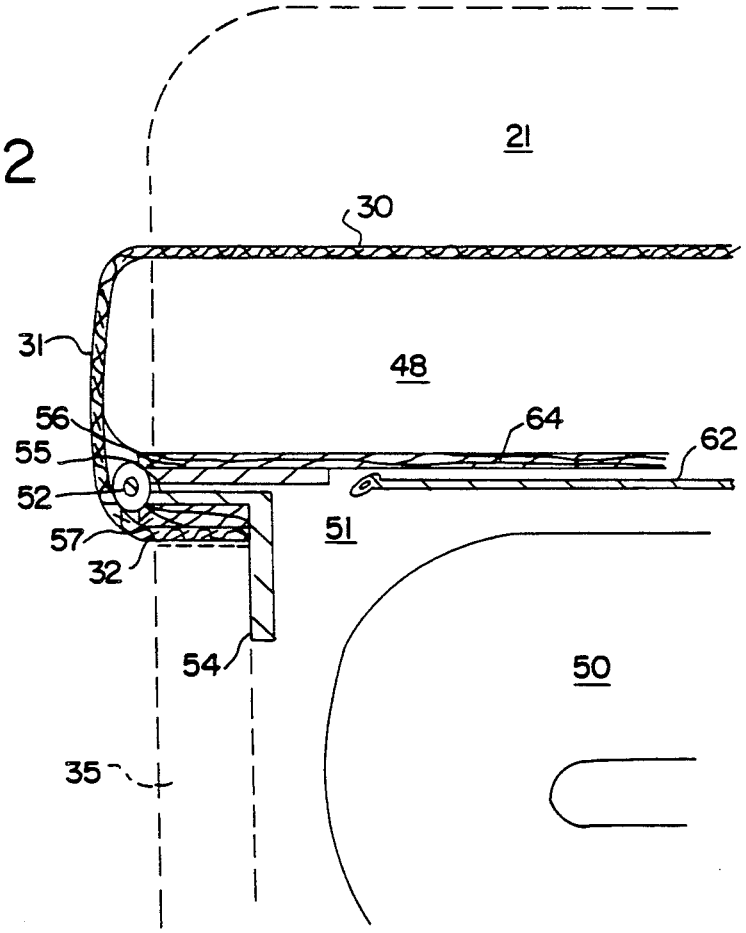

SYSTEM OF FABRIC COVERING

REFERENCE TO RELATED APPLICATION

This case is a continuation-in-part of application Ser. No. 07/702,910, filed May 20, 1991, still pending, entitled Convertible Sofa Bed Sofa System.

BACKGROUND OF THE INVENTION

The present invention relates to the art of fabric covering of furniture in which an exposed hinge would normally exist. In certain types of furniture systems, a hinge will connect a fixed portion of the system, such as a base, to a rotatable portion thereof. An example of such a system exist in my above referenced co-pending patent application which relates to a convertible sofa bed in which the sofa seat cushions, may, prior to use, be "rotated" from their normal horizontal position upon the sofa seat frame into a position representing a displacement of about 180 degrees. In order to accomplish this kind of function, a hinge arrangement must be utilized such that the sofa cushion can be rotated relative to the portion of the sofa which remains in a fixed location on the floor.

Although a mechanically suitable hinge arrangement may be effected directly between a vertical surface of the sofa base and a horizontal rigid bottom periphery of a sofa pillow, this arrangement results in an exposed hinge, as is more fully explained below in the Detail Description of the Invention. Such an exposed hinge is not only unsightly but, as well, has the potential to cause scratching or abrasion of the back of the leg of the user if one's leg is inadvertently positioned or forced against the forwardmost portion of the hinge.

Although the present invention originated as a response to the above need in the area of convertible sofa beds, it will be appreciated that other applications of the invention may occur in other furniture systems making use of otherwise exposed hinge elements.

The Applicant is unaware of prior art, other than his own experimentation, which is relevant to the invention as set forth herein.

SUMMARY OF THE INVENTION

The present invention constitutes a fabric covering system for use with an hinge element of a convertible sofa bed system in which the system includes a sofa base in which there is a disposed convertible sofa bed and, thereover, sofa cushions. The convertible sofa bed is rotatably connected by hinge means in the nature of a piano hinge, to a top area of a vertical front panel of the sofa system. Prior to unfolding of the bed portion of the sofa system, the sofa cushions, which are each provided with a rigid horizontal bottom periphery, may be rotated forwardly by 180 degrees so that, after such rotation, the sofa seat is thereby situated beneath the unfolded convertible bed portion in an unobstructive position which will not interfere with the normal use of the bed. In order to obviate unsightly hinge elements when the bed portion is not unfolded, fabric of the sofa seat which would otherwise be secured to said bottom horizontal peripheral surfaces of the sofa seat are extended over a protruding forward area of the hinge and, therefrom, behind said vertical front panel of the hinge, between the back of said panel and the underside of one hinge element which would otherwise be secured directly to said vertical front panel. Normal usage of the sofa cushion during periods when the convertible bed in not unfolded is unimpeded by the inventive fabric covering structure and system.

It is accordingly an object of the present invention to provide a system and method of fabric covering which will render more aesthetic furniture systems making use of exposed hinges.

It is another object of the present invention to provide a hinge covering system and method particularly adapted for use with convertible sofa bed systems having a sofa cushion which is connected by hinge means to a rigid base of the sofa.

The above and yet other objects and advantages of the present invention will become apparent from the hereinafter set forth Brief Description of the Drawings, Detailed Description of the Invention, and Claims appended herewith.

BRIEF DESCRIPTION OF THE DRAWINGS

FIG. 1 is a cross-sectional schematic view of one method of fabric connection with a hinge system.

FIG. 2 is a schematic, otherwise similar to FIG. 1, however, showing the present inventive fabric connection system and method.

DETAILED DESCRIPTION OF THE INVENTION

Figure 3:
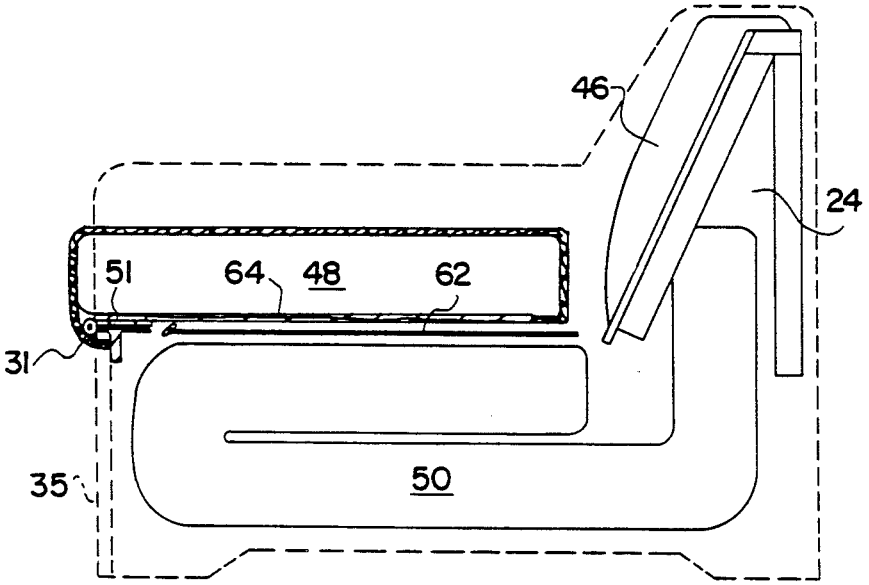
FIG. 3 is an enlarged view of FIG. 2 showing the relationship of the fabric connection region to the rest of a convertible sofa bed.

With reference to the view of FIG. 1, there is shown, in side schematic view, an illustration of my own earlier attempts, which attempts were never embodied in a commercialized product, to solve the problem of exposure of a hinge means in a piece of furniture having a rotatable element relative to a rigid non-rotatable element. More particularly, shown in FIG. 1 is a side arm 21 of a sofa bed having cushions 48, a convertible sofa module which includes a mattress 50 and a gripping and extension portion 62. The sofa bed is also provided with a front panel 35. Each cushion 48 is provided with a wood periphery 64 at the bottom thereof. Further, fabric 20 of cushion pillow 48 is secured about the edge of cushion 48 such that the lower portion thereof passes between said wood periphery 64 and an upper face 56 of hinge 51. By reason of the placement of fabric 20 between wood periphery 64 and the upper face 56 of hinge 51, most of hinge 51 will remain exposed with, resulting, an unsightly appearance to the piece of furniture when viewed front-on and, as well, the potential to scratch the legs of one inadvertently pushing in the direction of the hinge.

With reference to FIGS. 2 and 3, there is shown in respectively enlarged and unenlarged side schematic views, the inventive alternative to my earlier approach of FIG. 1 in which, fundamentally, fabric 30 of cushion 48 is extended downwardly and behind front panel 35 of the sofa coach. More particularly, in the views of FIGS. 2 and 3 it may be noted that a vertical portion 31 of fabric 30 extends downwardly past axle 52 of hinge 51 and, therefrom, between a wood strip 57 a lower horizontal face 55 of hinge 51, this extension corresponding to portion 32 of fabric 30. Therefrom, a portion 33 of fabric 30 turns vertically downwardly between front panel 35 and a vertical face 54 of hinge 51. Resulting, portions 32 and 33 of fabric 30 are substantially permanently held by the structural connection between hinge 51 and front panel 35.

With further reference to the view of FIGS. 2 and 3, it is noted that upper horizontal face 56 of hinge 51 is rigidly connected to said wood periphery 64 of cushion 48 and lower horizontal face 55 of hinge 51 is secured upon said wood strip 57. Vertical hinge face 54 is, as above noted, secured to both fabric portion 33 and front panel 35 as for example, by countersunk screw means. Countersunk screw means may also be employed to secure said upper horizontal face 56 to wood periphery 64 and said lower horizontal face 55 to said wood strip 57.

The aesthetic appearance of the entire structure, resulting from the above-described method and structure for fabric covering of hinge elements is seen with reference to the view of FIG. 3. Therein, the sofa coach is seen to include a frame element 24 and a back module cushion 46. Also, with reference to FIG. 3, hinge 51 cannot be noticed by the user and, as well, cannot be touched or felt during normal usage of the sofa couch.

Figure 4:
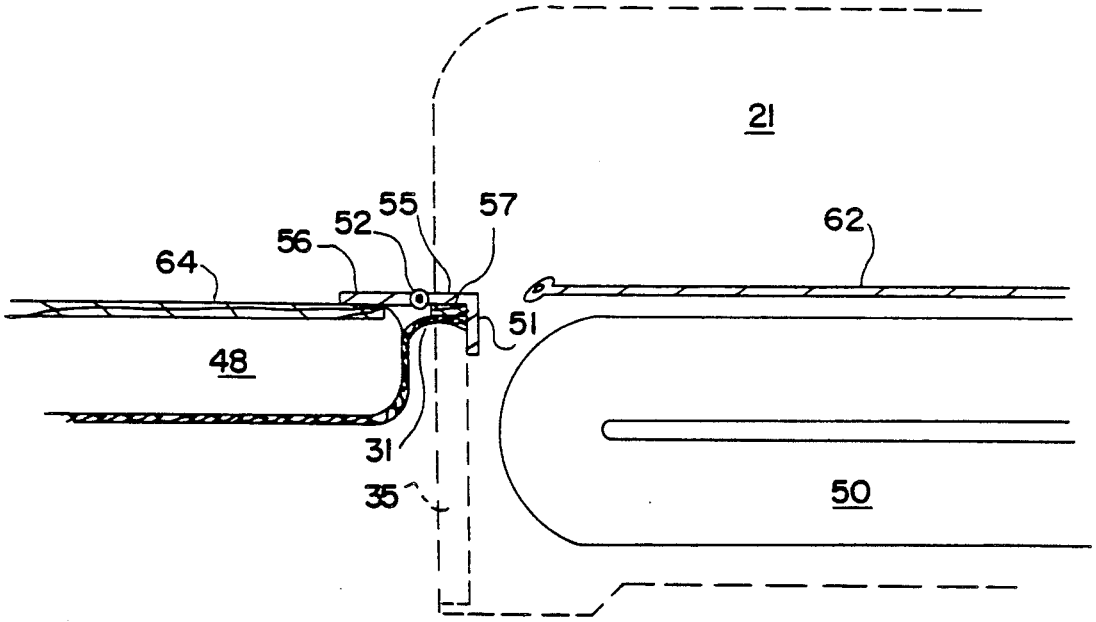
FIG. 4 is a side schematic view, similar to the view of FIG. 3, however, showing the sofa seat portion rotated into its forward position.

In the view of FIG. 4, the structure of FIGS. 2 and 3 is shown in which cushion 48 is rotated 180 degrees outwardly relative to the side arm 21 of the coach structure. Therein, it may be noted that portion 31 fabric 30 operates to maintain the hinge in a completely covered fashion even after cushion 48 has been rotated into the position which would exist after the conversion of the system into a convertible bed through the engagement of gripping portion 62.

It should be appreciated that fabric 30 is connected between front panel 35 and the hinge such that cushion 48 may be folded or unfolded without disruption of the appearance of the upper surface (sitting surface) of the cushion 48. Further, it has been found that the use of wood strip 57 is most helpful in obtaining an appropriate extend and degree of pressure upon the portion 32 of fabric 30 which is held between from panel 35 and lower horizontal face 55 of the hinge. Accordingly, it is to be understood that without the employment of wood strip 57, or equivalent resilient means such as a strip of polymer or hard rubber, portion 32 of fabric 30 could not be effectively maintained in its desired positions.

It is to be understood that the above technique and structure of securement of fabric over hinge means may be used in other furniture systems other than that of a convertible couch and, particularly, in any furniture system in which a moveable part is connected to a non-moveable part be exposed hinge.

Accordingly, while there has been shown and described a preferred embodiment of the present invention it is to be appreciated that the instant invention may be embodied otherwise than is herein specifically shown and described and within said embodiment certain changes may be made within the form and arrangements of the parts without departing from the underlying principles of this invention within the scope of the claims appended herewith.

Having thus described my invention what I claim as new, useful and non-obvious and, accordingly, secure by Letters Patent of the United States is:

1. A system of fabric covering for use with an exposed furniture hinge, the system comprising:

(a) a furniture assembly comprising a fixed base relative to a floor and a front panel;

(b) cushion means having a bottom surface, at least a portion of which is substantially rigid;

(c) hinge means secured between said fixed base and said bottom surface of said cushion means in which said cushion means may be rotated away from the fixed base, said hinge means comprising an upper horizontal face secured to said bottom surface of said cushion, an axle secured at one end of said horizontal face, a lower horizontal face positioned medially between said upper horizontal face and said front panel of said furniture assembly, and a vertical face secured behind said front panel;

(d) resilient strip means disposed along a horizontal axis of said furniture system and in abutment with said lower horizontal face of said hinge means and a top edge of said front panel; and (e) a fabric covering which extends over said hinge axle and between the top of said front panel and a bottom of said resilient strip.

* * * * *